US010583451B2

(12) United States Patent
Pihlblad

(10) Patent No.: US 10,583,451 B2
(45) Date of Patent: Mar. 10, 2020

(54) WORK BOOTH SAFETY SYSTEM FOR AN AUTOMOTIVE BODY REPAIR SHOP

(71) Applicant: PIVAB AB, Veddige (SE)

(72) Inventor: Ronny Pihlblad, Veddige (SE)

(73) Assignee: PIVAB AB, Veddige (SE)

( * ) Notice: Subject to any disclaimer, the term of this patent is extended or adjusted under 35 U.S.C. 154(b) by 153 days.

(21) Appl. No.: 15/760,015

(22) PCT Filed: Sep. 21, 2016

(86) PCT No.: PCT/SE2016/050885
§ 371 (c)(1),
(2) Date: Mar. 14, 2018

(87) PCT Pub. No.: WO2017/058075
PCT Pub. Date: Apr. 6, 2017

(65) Prior Publication Data

US 2018/0257098 A1 Sep. 13, 2018

(30) Foreign Application Priority Data

Sep. 29, 2015 (SE) ..... 1530144

(51) Int. Cl.
*B05B 16/60* (2018.01)
*B05B 16/20* (2018.01)
*B05B 16/40* (2018.01)

(52) U.S. Cl.
CPC ..... *B05B 16/20* (2018.02); *B05B 16/40* (2018.02); *B05B 16/60* (2018.02)

(58) Field of Classification Search
CPC ..... B05B 16/00–95
See application file for complete search history.

(56) References Cited

U.S. PATENT DOCUMENTS 5,473,844 A 12/1995 Martin
2003/0143940 A1* 7/2003 DeRegge ..... B05B 16/60 454/52

(Continued)

FOREIGN PATENT DOCUMENTS

WO 98/35195 A1 8/1998
WO 2012/085535 A1 6/2012

(Continued)

OTHER PUBLICATIONS

International Search Report, dated Dec. 12, 2016, from corresponding PCT/SE2016/050885 application.

(Continued)

*Primary Examiner* — Babajide A Demuren
(74) *Attorney, Agent, or Firm* — Young & Thompson

(57) ABSTRACT

Disclosed is a work booth safety system for an automotive body repair shop including a work booth with a ventilation system for evacuation of polluted air and an entrance closed or opened by a door or drape. The work booth is configurable into three different work modes: 1) For preparative dent repair, the entrance is kept open and electrical sockets and compressed air supply is deactivated. Ventilation air flow is mainly directed in a horizontal direction and evacuated through a wall ventilation outlet duct. 2) For spray application of a body sanding foundation, the entrance is closed and electrical sockets are deactivated, the compressed air supply is activated, and the ventilation air flow matches that of work mode 1. 3) For welding, the entrance is closed and electrical sockets are activated. The compressed air supply is deactivated and the ventilation air flows vertically upward through a roof ventilation outlet duct.

20 Claims, 2 Drawing Sheets

(56) References Cited

U.S. PATENT DOCUMENTS

| | | | | |
|---|---|---|---|---|
| 2005/0068774 | A1* | 3/2005 | Pippa | B05B 16/40 362/253 |
| 2007/0093193 | A1* | 4/2007 | Cook | B05B 16/60 454/52 |
| 2009/0203306 | A1 | 8/2009 | Sugata | |
| 2015/0259941 | A1* | 9/2015 | Hanson | B60S 5/00 52/31 |
| 2017/0291188 | A1* | 10/2017 | Blackwell | B05B 16/80 |

FOREIGN PATENT DOCUMENTS

| | | | |
|---|---|---|---|
| WO | 2013/023870 | A1 | 2/2013 |
| WO | 2013/117882 | A1 | 8/2013 |

OTHER PUBLICATIONS

Extended European Search Report issued in European Patent Application No. 16852174.8 dated Apr. 4, 2019.

* cited by examiner

WORK BOOTH SAFETY SYSTEM FOR AN AUTOMOTIVE BODY REPAIR SHOP

TECHNICAL FIELD

The invention relates to a Work booth safety system for an automotive body repair shop including work booth with a ventilation system for evacuation of polluted air and an entrance arranged to be selectively closed or opened by means of a door or drape.

BACKGROUND

In an automotive body repair shop, a car body with minor body damages is normally repaired in several steps, such as preparative work where dents and other body damages are initially straightened out and prepared before later spray application of a body sanding foundation, welding and final repainting in a paint booth. Typically, the different work steps or work stations before final repainting are carried out in separate locations within the repair shop or at separate distant locations outside of the body repair shop itself. In the latter case, valuable time is lost due to transport logistics. Very often, welding repair work is carried out with insufficient ventilation and not in a separated environment from the general area in the body repair shop. This means that staff working at the repair shop is indirectly subjected to health-endangering welding fumes which in the long run may seriously impair the general health status of the staff. Furthermore, in many workshops there is a risk of explosion when using flammable gases from the application of a body sanding foundation at the same time as a welding operation.

Hence, there are both potential health problems and logistical problems associated with automotive repair shops.

SUMMARY

The object of the invention is to alleviate the problems mentioned above by providing a work booth safety system for an automotive body repair shop including a work booth with a ventilation system for evacuation of polluted air and an entrance arranged to be selectively closed or opened by means of a door or drape. The invention is especially characterized in that the work booth is arranged to be selectively configured into three different work modes depending on three corresponding work tasks, namely:

- a first work mode for preparative dent repair work on a car, wherein the entrance is kept open and electrical sockets and compressed air supply for spray guns are deactivated and the ventilation air flow is mainly directed in a horizontal direction within the work booth and evacuated through a wall ventilation outlet duct;
- a second work mode for spray application of a body sanding foundation on a car, wherein the entrance is closed and electrical sockets are kept deactivated whilst the compressed air supply for spray guns is activated and the ventilation air flow is still generally directed in a horizontal direction and evacuated through said wall ventilation outlet duct; and
- a third work mode for welding work on a car, wherein the entrance is closed and electrical sockets are activated whilst the compressed air supply for spray guns is deactivated and the ventilation air flow is generally directed in a vertical direction from the floor towards the roof of the work booth where it is evacuated through a roof ventilation outlet duct.

In an advantageous embodiment of the invention, the work booth is provided with a control unit coupled to a sensor positioned at the entrance for detecting whether the entrance is open or closed by said door or drape. The control unit is arranged to allow the second and third work modes exclusively on the condition that the entrance is closed.

Suitably, the control unit comprises a work mode setting switch and selectively opens or closes the wall- or roof ventilation outlet ducts depending on the selected work mode so that:

- the wall ventilation outlet duct is open and the roof ventilation outlet duct is closed when the first or second work mode is selected, and
- the roof ventilation outlet duct is open and the wall ventilation outlet duct is closed when the third work mode is selected.

The ventilation system is preferably provided with a final common outlet duct connected to both the wall ventilation outlet duct and the roof ventilation outlet duct. A ventilation fan is then connected to the final common outlet duct.

In a well-functioning embodiment of the invention, the ventilation system is provided with a ventilation inlet duct placed in the roof of the work booth adjacent to the entrance.

Preferably, the roof ventilation outlet duct is provided with multiple inlet openings in the roof of the work booth. Furthermore, the wall ventilation outlet duct is positioned adjacent to the floor of the work booth.

The invention provides an advantage over previously known technology, primarily due to the fact that the work booth safety system prevents the use of flammable gases from the application of a body sanding foundation at the same time as a welding operation.

Furthermore, the work booth safety system according to the invention may be applied in multiple work booths placed next to or near each other and since each work booth has its own ventilation system, they may be used in different work modes simultaneously for cars in different stages of repair within the same workshop.

The ventilated work booth also means a substantial improvement in the work environment for workshop staff not directly involved in the repair work within the booth who otherwise would have breathed in potentially health-endangering welding fumes or fumes from the spray application of the sanding foundation. The work booth is also sound insulated so that staff outside the work booth experiences a quieter work environment.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

DETAILED DESCRIPTION OF EXAMPLE EMBODIMENTS OF THE INVENTION

Figure 1:
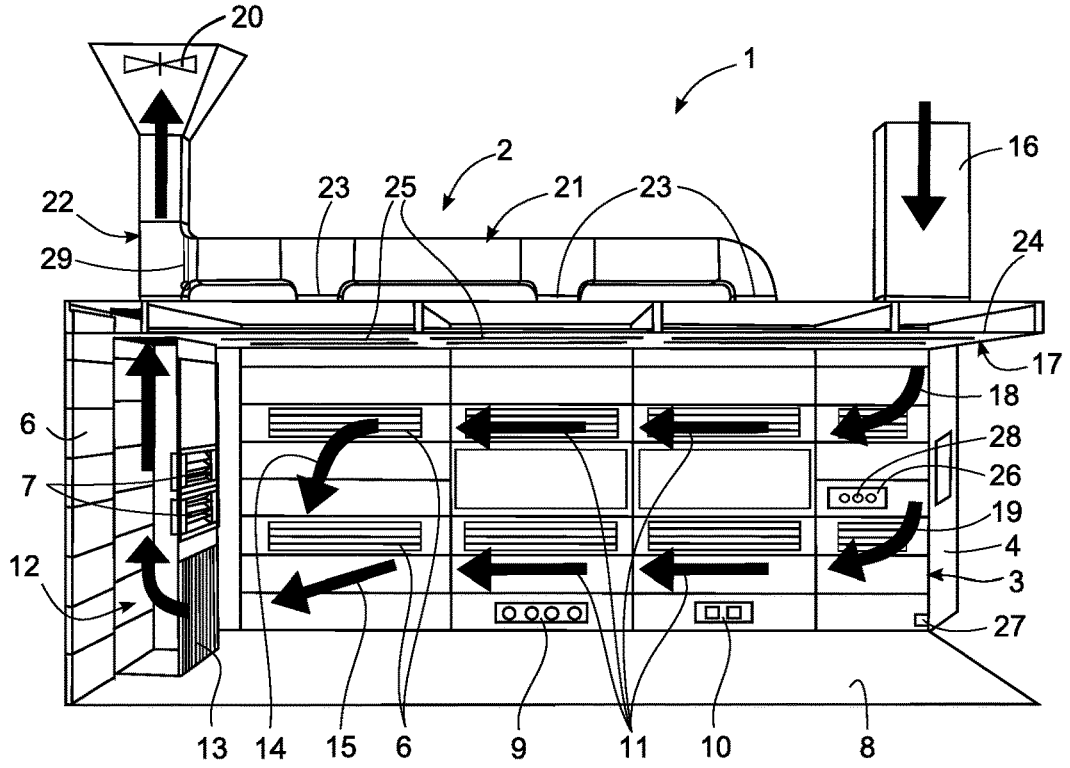
FIG. 1 shows a schematic view of the work booth safety system set to a first work mode for preparative dent repair work on a car according to the present invention.

The invention will now be described with reference to embodiments of the invention and with reference to the appended drawings. With initial reference to FIG. 1, this figure shows a schematic overview of a work booth safety system for an automotive body repair shop including a work booth 1 with a ventilation system 2 for evacuation of polluted air including welding fumes, spray paint fumes and grinding dust from grinding or sanding work on a car body (not shown). The work booth 1 is provided with an entrance 3 which arranged to be selectively closed or opened by means of a door 4, shown in an open position in FIG. 1. The entrance 3 may alternatively be provided with a drape (not shown).

Furthermore, the work booth 1 is generally rectangular in shape and has sound insulated side walls 5 and an end wall 6 positioned opposite to the entrance 3. The side wall 5 and the end wall 6 are provided with multiple light armatures 6, 7 at two height levels from the floor 8. The light armatures 6, 7 are approved for use in areas with potential explosion risk due to flammable gases and are directed towards the typical work area on a car (not shown) centrally placed in the work booth 1. Electrical sockets 9 and a compressed air supply panel 10 are provided in the side walls 5 and are arranged to be activated or deactivated depending on three different work modes depending on three corresponding work tasks.

A first work mode for preparative dent repair work on a car (not shown) is shown in FIG. 1, wherein the entrance 3 is kept open and the electrical sockets 9 and compressed air supply panel 10 for spray guns (not shown) are deactivated. In this first work mode, the ventilation air flow as indicated by the arrows 11 is mainly directed in a horizontal direction within the work booth 1 and evacuated through a wall ventilation outlet duct 12 via a slotted inlet panel 13 in the end wall 6. The wall ventilation outlet duct 12 is positioned adjacent to the floor 8 of the work booth 1 so that the ventilation air flow is forced downwardly towards the floor 8 as indicated by arrows 14, 15 just before exiting the work booth 1. A ventilation inlet duct 16 is positioned in the roof of the work booth 1 adjacent to—and above the entrance 3. Hence, the ventilation air flow is initially directed vertically downwards from the roof 17 but is then turned in a horizontal direction according to the curved arrows 18, 19. A ventilation fan 20 is arranged to draw air by suction through the wall ventilation outlet duct 12—and in a third work mode to be described below—through a roof ventilation outlet duct 21. The ventilation fan 20 is connected to both the wall ventilation outlet duct 12 and the roof ventilation outlet duct 21 via a final ventilation outlet duct 22. As seen in FIG. 1, the roof ventilation outlet duct 21 is provided with multiple inlet openings in the roof 17 of the work booth 1. The roof 17 is formed as a two-layered structure with an inner ceiling sheet layer 24 provided with a multiplicity of ventilation slots 25. The ventilation slots 25 may alternatively be shaped as a perforated ventilation grid (not shown).

Figure 2:
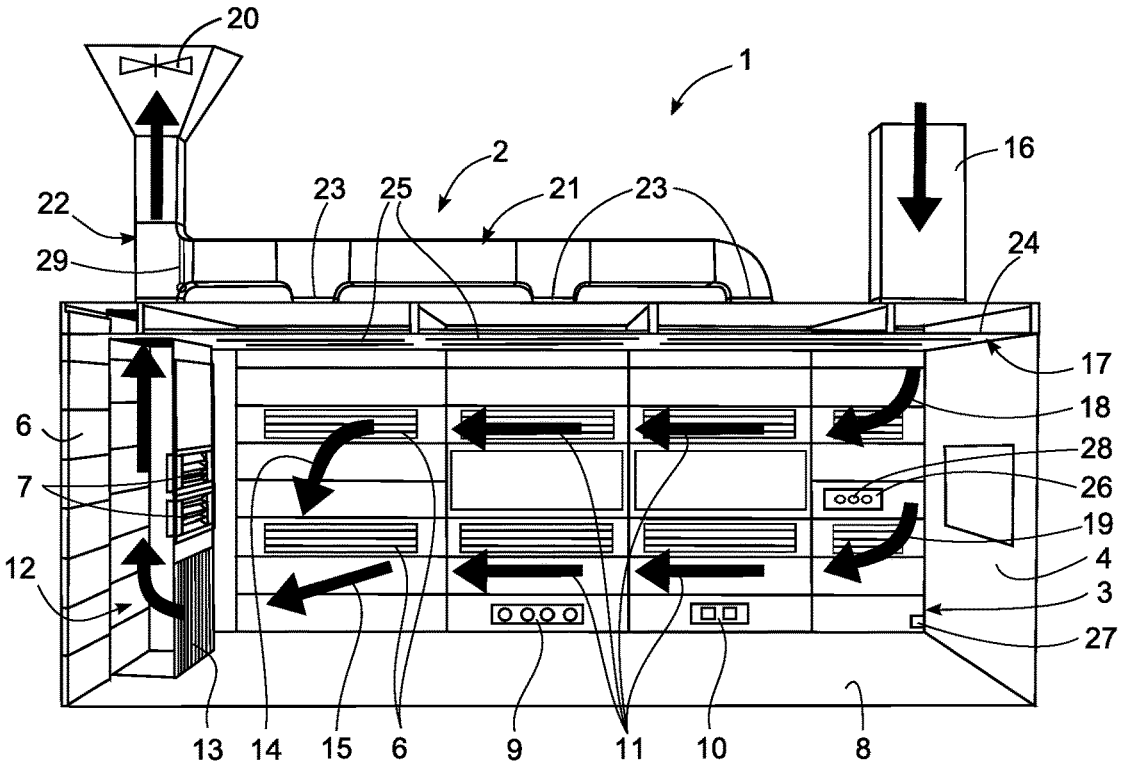
FIG. 2 shows a schematic view of the work booth safety system set to second work mode for spray application of a body sanding foundation on the car a second work mode for spray application of a body sanding foundation on a car, and FIG. 3 finally shows a schematic view of the work booth safety system set to a third work mode for welding work on a car.

In FIG. 2, a second work mode for spray application of a body sanding foundation on a car is shown. Here, the entrance 3 is closed and electrical sockets 9 are kept deactivated whilst the compressed air supply 10 for spray guns is activated and the ventilation air flow is still generally directed in a horizontal direction of the arrows 11 and evacuated through said wall ventilation outlet duct 12 in the same manner as in the previously described first work mode.

Figure 3:
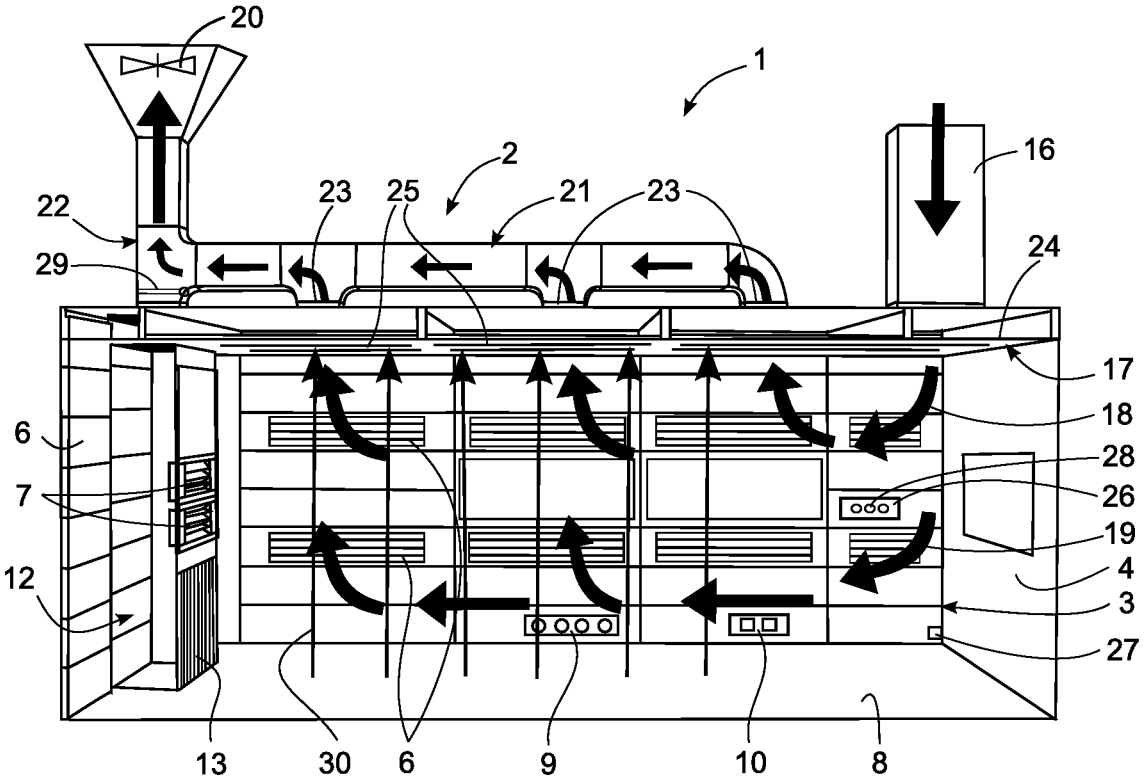

In FIG. 3, a third work mode for welding work on a car is shown. Here, the entrance 3 is closed and electrical sockets 9 are activated whilst the compressed air supply for spray guns is deactivated. The ventilation air flow is now generally directed in a vertical direction from the floor 8 towards the roof 17 of the work booth 1 where it is evacuated through the roof ventilation outlet duct 21. This ventilation direction offers the most efficient way to evacuate the hot welding fumes that move upwardly because of their heat according to the vertical arrows 30 in the figure.

The work booth 1 is provided with a control unit 26 coupled to a sensor 27 positioned at the entrance 3 for detecting whether the entrance 3 is open or closed by said door or drape 4. The control unit 26 is arranged to allow the second and third work modes exclusively on the condition that the entrance 3 is closed. The control unit 26 comprises a work mode setting switch 28 and selectively opens or closes the wall- or roof ventilation outlet ducts 12, 21 depending on the selected work mode so that:

- the wall ventilation outlet duct 12 is open and the roof ventilation outlet duct 21 is closed when the first or second work mode is selected, and
- the roof ventilation outlet duct 21 is open and the wall ventilation outlet duct 12 is closed when the third work mode is selected.

For this purpose, the wall- or roof ventilation outlet ducts 12, 21 may be selectively opened or shut by means of a valve 29 positioned in the final common ventilation duct 22 which is controlled by the control unit 26. In FIGS. 1 and 2, the valve 22 is set to allow suction through the wall ventilation outlet 12, whereas in FIG. 3, the valve 29 is set to allow suction through the roof ventilation outlet duct 21. In an alternative embodiment of the invention, the wall- or roof ventilation outlet ducts 12, 21 may each be provided with a valve (not shown).

It is to be understood that the present invention is not limited to the embodiments described above and illustrated in the drawings and a skilled person will recognize that many changes and modifications may be made within the scope of the appended claims.

The invention claimed is:

1. Work booth safety system for an automotive body repair shop including a work booth (1) with a ventilation system (2) for evacuation of polluted air and an entrance arranged to be selectively closed or opened by means of a door or drape (4), wherein the work booth (1) is arranged to be selectively configured into three different work modes depending on three corresponding work tasks, namely:

- a first work mode for preparative dent repair work on a car, wherein the entrance (3) is kept open and electrical sockets (9) and compressed air supply (10) for spray guns are deactivated and the ventilation air flow is mainly directed in a horizontal direction within the work booth (1) and evacuated through a wall ventilation outlet duct (12);
- a second work mode for spray application of a body sanding foundation on a car, wherein the entrance (3) is closed and electrical sockets (9) are kept deactivated whilst the compressed air supply (10) for spray guns is activated and the ventilation air flow is still generally directed in a horizontal direction and evacuated through said wall ventilation outlet duct (12); and
- a third work mode for welding work on a car, wherein the entrance (3) is closed and electrical sockets (9) are activated whilst the compressed air supply (10) for spray guns is deactivated and the ventilation air flow is generally directed in a vertical direction from the floor (8) towards the roof (17) of the work booth (1) where it is evacuated through a roof ventilation outlet duct (21).

2. Work booth safety system for an automotive body repair shop according to claim 1, wherein the work booth (1) is provided with a control unit (26) coupled to a sensor (27) positioned at the entrance for detecting whether the entrance (3) is open or closed by said door or drape (4), said control unit (26) being arranged to allow the second and third work modes exclusively on the condition that the entrance (3) is closed.

3. Work booth safety system for an automotive body repair shop according to claim 2, wherein the control unit (26) comprises a work mode setting switch and selectively opens or closes the wall- or roof ventilation outlet ducts (12, 21) depending on the selected work mode so that:

the wall ventilation outlet duct (12) is open and the roof ventilation outlet duct (21) is closed when the first or second work mode is selected, and the roof ventilation outlet duct (21) is open and the wall ventilation outlet duct (12) is closed when the third work mode is selected.

4. Work booth safety system for an automotive body repair shop according to claim 1, wherein the ventilation system (2) is provided with a final common outlet duct (22) connected to both the wall ventilation outlet duct (12) and the roof ventilation outlet duct (21).

5. Work booth safety system for an automotive body repair shop according to claim 4, wherein a ventilation fan is connected to the final common outlet duct (22).

6. Work booth safety system for an automotive body repair shop according to claim 1, wherein the ventilation system is provided with a ventilation inlet duct (16) placed in the roof (17) of the work booth (1) adjacent to the entrance (3).

7. Work booth safety system for an automotive body repair shop according to claim 1, wherein the roof ventilation outlet duct (21) is provided with multiple inlet openings (23) in the roof of the work booth (1).

8. Work booth safety system for an automotive body repair shop according to claim 1, wherein the wall ventilation outlet duct (12) is positioned adjacent to the floor (8) of the work booth (1).

9. Work booth safety system for an automotive body repair shop according to claim 2, wherein the ventilation system (2) is provided with a final common outlet duct (22) connected to both the wall ventilation outlet duct (12) and the roof ventilation outlet duct (21).

10. Work booth safety system for an automotive body repair shop according to claim 3, wherein the ventilation system (2) is provided with a final common outlet duct (22) connected to both the wall ventilation outlet duct (12) and the roof ventilation outlet duct (21).

11. Work booth safety system for an automotive body repair shop according to claim 2, wherein the ventilation system is provided with a ventilation inlet duct (16) placed in the roof (17) of the work booth (1) adjacent to the entrance (3).

12. Work booth safety system for an automotive body repair shop according to claim 3, wherein the ventilation system is provided with a ventilation inlet duct (16) placed in the roof (17) of the work booth (1) adjacent to the entrance (3).

13. Work booth safety system for an automotive body repair shop according to claim 4, wherein the ventilation system is provided with a ventilation inlet duct (16) placed in the roof (17) of the work booth (1) adjacent to the entrance (3).

14. Work booth safety system for an automotive body repair shop according to claim 5, wherein the ventilation system is provided with a ventilation inlet duct (16) placed in the roof (17) of the work booth (1) adjacent to the entrance (3).

15. Work booth safety system for an automotive body repair shop according to claim 2, wherein the roof ventilation outlet duct (21) is provided with multiple inlet openings (23) in the roof of the work booth (1).

16. Work booth safety system for an automotive body repair shop according to claim 3, wherein the roof ventilation outlet duct (21) is provided with multiple inlet openings (23) in the roof of the work booth (1).

17. Work booth safety system for an automotive body repair shop according to claim 4, wherein the roof ventilation outlet duct (21) is provided with multiple inlet openings (23) in the roof of the work booth (1).

18. Work booth safety system for an automotive body repair shop according to claim 5, wherein the roof ventilation outlet duct (21) is provided with multiple inlet openings (23) in the roof of the work booth (1).

19. Work booth safety system for an automotive body repair shop according to claim 6, wherein the roof ventilation outlet duct (21) is provided with multiple inlet openings (23) in the roof of the work booth (1).

20. Work booth safety system for an automotive body repair shop according to claim 2, wherein the wall ventilation outlet duct (12) is positioned adjacent to the floor (8) of the work booth (1).

* * * * *